US008550870B2

(12) United States Patent
Laurienzo et al.

(10) Patent No.: US 8,550,870 B2
(45) Date of Patent: Oct. 8, 2013

(54) TRACK SET WITH A TILTABLE SURFACE FOR USE WITH A TOY VEHICLE

(75) Inventors: Dominic Laurienzo, Los Angeles, CA (US); Michael Bernstein, Hermosa Beach, CA (US); Gabriel Carlson, Los Angeles, CA (US); Dion Fields, Thousand Oaks, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 106 days.

(21) Appl. No.: 12/655,465

(22) Filed: Dec. 29, 2009

(65) Prior Publication Data

US 2010/0279583 A1 Nov. 4, 2010

Related U.S. Application Data

(63) Continuation-in-part of application No. 12/587,625, filed on Oct. 10, 2009.

(60) Provisional application No. 61/195,812, filed on Oct. 10, 2008, provisional application No. 61/203,769, filed on Dec. 29, 2008.

(51) Int. Cl.
*A63H 18/00* (2006.01)

(52) U.S. Cl.
USPC ..... 446/444; 446/168; 273/109; 273/118 R

(58) Field of Classification Search
USPC ..... 446/444, 429, 334, 336, 168–174; 273/109, 110, 118 R, 119 R, 121 R
See application file for complete search history.

(56) References Cited

U.S. PATENT DOCUMENTS

| | | | | | |
|---|---|---|---|---|---|
| 1,291,105 | A | * | 1/1919 | Parker | 273/110 |
| 2,767,986 | A | * | 10/1956 | Newberry | 463/69 |
| 2,809,039 | A | * | 10/1957 | Glass | 446/336 |
| 3,318,600 | A | | 5/1967 | Glass et al. | |
| 3,603,032 | A | | 9/1971 | Heron | |
| 3,815,911 | A | * | 6/1974 | Cooper | 446/257 |
| 4,091,563 | A | * | 5/1978 | Noble et al. | 446/334 |
| 4,227,693 | A | * | 10/1980 | Moe et al. | 446/444 |
| 4,249,743 | A | * | 2/1981 | Lee | 273/391 |
| 4,325,551 | A | * | 4/1982 | Kulesza et al. | 273/110 |
| 4,394,961 | A | * | 7/1983 | Muller | 446/444 |
| 4,448,416 | A | * | 5/1984 | Belter | 273/110 |
| 4,475,305 | A | | 10/1984 | Kawakami et al. | |
| 4,516,953 | A | * | 5/1985 | Hippely et al. | 446/444 |
| 4,631,041 | A | | 12/1986 | Chang et al. | |
| 4,673,182 | A | * | 6/1987 | Bowen | 273/110 |
| 4,685,894 | A | | 8/1987 | Beny et al. | |
| 4,982,961 | A | | 1/1991 | Ichimura | |

(Continued)

FOREIGN PATENT DOCUMENTS

FR 2614800 A1 * 11/1988

*Primary Examiner* — Gene Kim
*Assistant Examiner* — Urszula M Cegielnik
(74) *Attorney, Agent, or Firm* — Tope-McKay & Associates

(57) ABSTRACT

Described is a track set with a tiltable surface for use with a toy vehicle. The track set includes a handle that allows a user to tilt the surface while resting the track set on a base and tilting the surface at a pivot point. Further, the surface includes a first side and a second side. The track set is formed to allow a user to switch the position of the pivot point and base and thereby selectively use either the first side or second side.

18 Claims, 10 Drawing Sheets

(56) References Cited

U.S. PATENT DOCUMENTS

| | | | | |
|---|---|---|---|---|
| 5,042,808 | A * | 8/1991 | Shoptaugh | 273/110 |
| 5,823,845 | A | 10/1998 | O'Berrigan | |
| 6,461,238 | B1 * | 10/2002 | Rehkemper et al. | 463/6 |
| 6,682,394 | B2 | 1/2004 | Tilbor et al. | |
| 6,786,796 | B2 | 9/2004 | Suto | |
| 7,329,167 | B2 | 2/2008 | Nagasaka et al. | |
| 7,628,674 | B2 * | 12/2009 | Nuttall et al. | 446/444 |
| 2007/0207699 | A1 | 9/2007 | Hoeting et al. | |
| 2008/0032596 | A1 * | 2/2008 | Sheltman | 446/444 |
| 2008/0070474 | A1 * | 3/2008 | Nuttall | 446/444 |
| 2011/0223829 | A1 * | 9/2011 | Sheltman | 446/444 |

* cited by examiner

TRACK SET WITH A TILTABLE SURFACE FOR USE WITH A TOY VEHICLE

PRIORITY CLAIM

This is a Continuation-in-Part application of U.S. Non-Provisional application Ser. No. 12/587,625 filed on Oct. 10, 2009, which is pending and is a non-provisional application of U.S. Provisional Application No. 61/195,812, filed on Oct. 10, 2008, which is expired. This is ALSO a non-provisional patent application of U.S. Provisional Application No. 61/203,769, filed on Dec. 29, 2008, and entitled, "Track Set for Use With a Toy Vehicle."

BACKGROUND OF THE INVENTION (1) Field of Invention

The present invention relates to a track set and, more particularly, to a track set with a tiltable surface for use with a toy vehicle.

(2) Description of Related Art

Track sets for use with toy cars have long been known in the art. Conventional track sets use a standard toy vehicle with u-shaped tracks. Such track sets are commonly used with die-cast cars and are formed to provide a variety of stunts. For example, such track sets have been formed to provide loops and jumps through which the cars travel or launch.

While such track sets are enjoyable for watching the vehicle after it is released into the track set, they do not typically provide for further interaction or manipulation of the track set itself after such release. Further, recent improvements have been devised to include a flywheel within the vehicle itself, such that the vehicle is a flywheel-powered toy vehicle. Additional features can be envisioned through use of the flywheel.

Thus, a continuing need exists for a track set that is operable with a flywheel-powered toy vehicle and that allows for manipulation of the track set after the vehicle is released into the track set.

SUMMARY OF INVENTION

The present invention relates to track set for use with a toy vehicle. The track set includes a tiltable surface to allow a user to manipulate the surface while the toy vehicle traverses the surface. The track set includes a base and a surface upon which a toy vehicle can traverse. The surface is rotatably connected with the base. A handle is attached with the surface to allow a user to rotate (tilt) the surface with respect to the base and thereby manipulate the toy vehicle.

In another aspect, the surface is a substantially planar surface.

In yet another aspect, the surface includes a first side and a second side, with a pivot point connected with at least one of the first and second sides. Thus, rotating the surface using the handle causes the surface to rotate about the pivot point. The pivot point is a semi-circular attachment that is detachably attachable with at least one of the first and second sides.

In another aspect, obstacles are included that are removably attachable with the surface, whereby a user can guide a toy vehicle into contact with the obstacles.

Additionally, the surface includes side rails to maintain a toy vehicle thereon.

In yet another aspect, the surface includes multiple exit points through which the toy vehicle can be guided off of the surface.

Additionally, an elevation adjuster is attached with surface to elevate at least one end of the surface and alter an angle of the surface with respect to a ground plane.

Finally, as can be appreciated by one skilled in the art, the present invention also includes a method for forming and using the track set. For example, the method for forming the track set includes a plurality of acts of forming and connected the various components described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a track set and, more particularly, to a track set with a tiltable surface for use with a toy vehicle. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C.

Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As noted above, the present invention is a track set with a tiltable surface for use with a toy vehicle. The track set is formed to operate with a mobile toy vehicle that includes a flywheel (or a traditional toy vehicle without a flywheel, such as a die-cast toy car, boat, plane, skateboard, figurine, etc.).

Figure 1:
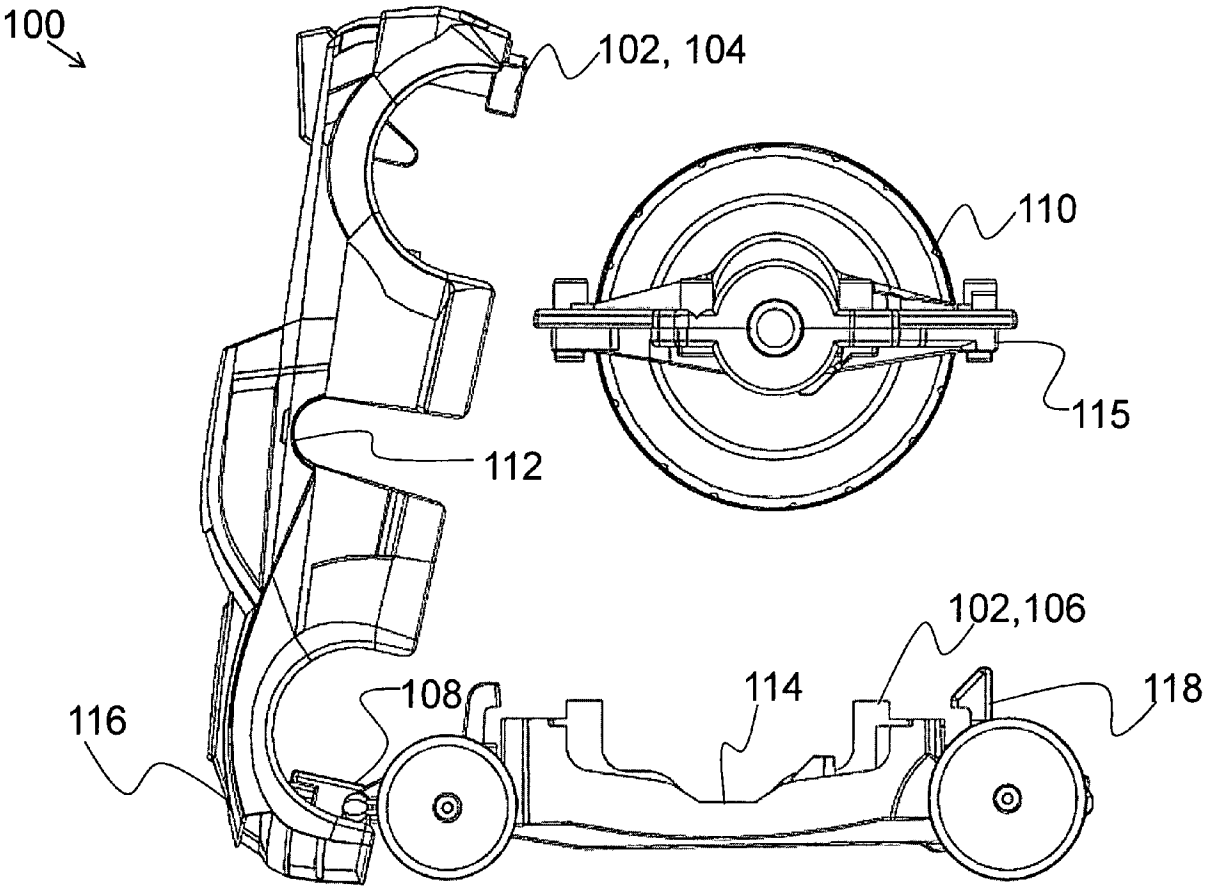
FIG. 1 is an illustration of a toy-vehicle that can be used with a track set of the present invention.
Figure 2:
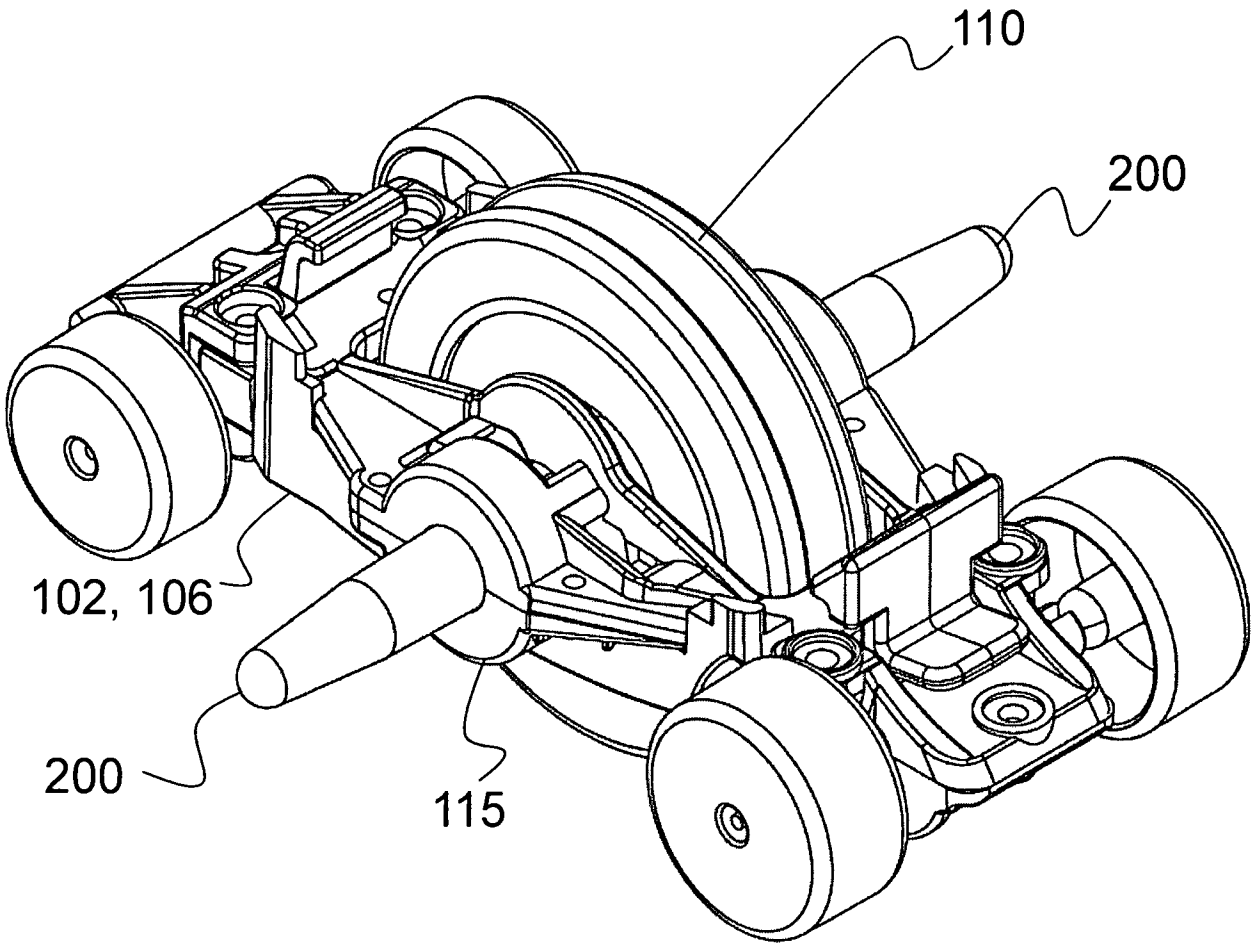
FIG. 2 is an illustration of the toy vehicle, depicting its internal flywheel and frame.
Figure 3:
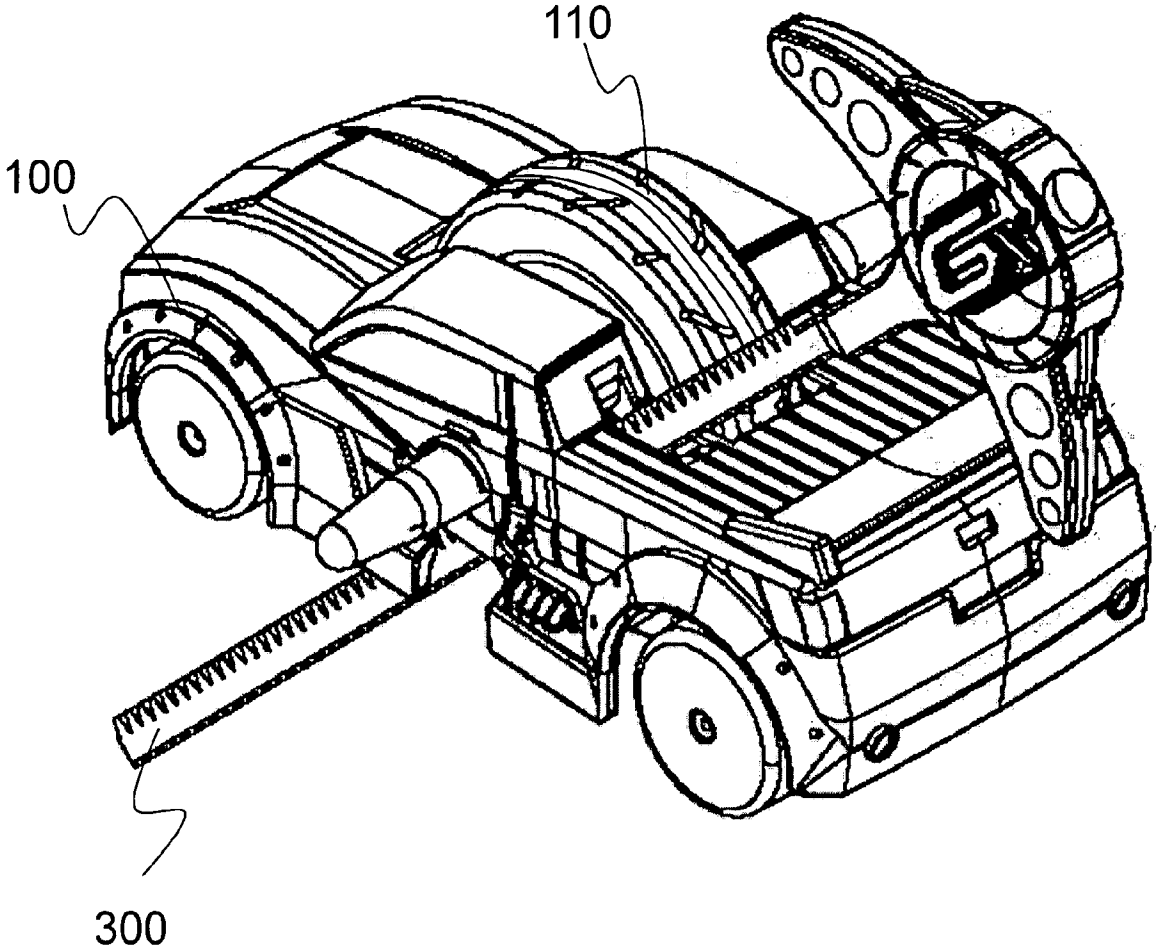
FIG. 3 is an illustration of the toy vehicle, depicting the toy vehicle fully assembled.

Before describing the present invention, a description of a toy vehicle that can be used with the track set is provided and illustrated in FIGS. 1 through 3. It should be understood that the toy vehicle that is described and illustrated is for illustrative purposes only as the present invention is not limited thereto and can be used with a variety of vehicles and mobile items. Other mobile items include balls, marbles, etc. Following the description of the toy vehicle, the track set with a tiltable surface according to the present invention is described.

(1.1) Toy Vehicle

FIG. 1 illustrates a side-view of a mobile toy 100, shown as a toy car, depicting a body member 102 which includes a top portion 104 and a bottom portion 106 (or chassis) arranged in a clamshell style. In a desired aspect, the mobile toy 100 is a 1/64 scale miniature toy vehicle; however, all scales of toy vehicles are possible. The body member 102 may be comprised of any durable and lightweight material, non-limiting examples of which include plastic and metal. In one aspect, the top portion 104 and the bottom portion 106 of the body member 102 are connected by at least one point by a connector 108 to allow the top portion 104 to pivot away from the bottom portion 106, converting the body member 102 to an opened configuration as shown in FIG. 1. The connector 108 may be a hinge or any suitable connector which would allow the top portion 104 to pivot away from the bottom portion 106. Alternatively, the top portion 104 may be completely removable from the bottom portion 106 and may be detachably attached through a snap-fit mechanism, for example. This characteristic provides a user with the ability to interchange body styles for the mobile toy 100. Furthermore, the body member 102 may comprise multiple hinged and/or snap-fit fixtures to form the mobile toy 100.

Opening (or removal) of the top portion 104 of the body member 102 away from the bottom portion 106 of the body member 102 provides access to a weighted displaceable flywheel 110 for its placement in or removal from the bottom portion 106 of the mobile toy 100. The unique configuration of the body member 102 allows a user to easily remove the flywheel 110 from the mobile toy 100 and replace it with a flywheel 110 of a different style to provide a new play experience. Additionally, the configuration of the body member 102 provides the capability of easily repositioning the flywheel 110 within the body member 102. In one aspect, the mobile toy 100 includes a sub-chassis 115 which is formed to fit into the bottom portion 106 of the mobile toy 100, as shown. The flywheel 110 is positioned in the sub-chassis 115, which is then placed in the bottom portion 106. Furthermore, the body member 102 comprises a front portion 116, a rear portion 118, and a perimeter bounded by the front portion 116 and the rear portion 118.

In one aspect, the bottom portion 106 further comprises at least one notch 114 on both sides to receive the flywheel 110 and/or sub-chassis 115. Additionally, the top portion 104 comprises at least one corresponding notch 112 on both sides of the top portion 104, which is aligned with the notch 114 of the bottom portion 106, to provide space for a portion of the flywheel 110 and/or sub-chassis 115 when the mobile toy 100 is in a closed configuration. In a desired aspect, the inclusion of multiple aligned notches 112 and 114 in the top portion 104 and bottom portion 106 allows for multiple adjustments of the flywheel 110 at different positions in the mobile toy 100.

In another aspect, the mobile toy 100 comprises multiple lock configurations which lock the portions of the body member 102 and/or the flywheel 110 in place. As a non-limiting example, at least one snap-fit fixture secures the flywheel 110 into its proper place on the bottom portion 106. Therefore, additional fasteners and tools are not required for a user to access the flywheel 110.

As described above, the inclusion of multiple notches 114 along the bottom portion 106 of the mobile toy 100 allows for variable placement of the flywheel 110 to allow a user to easily reposition they flywheel 110 in the mobile toy. The flywheel 110 may be shifted to multiple positions within the mobile toy (e.g., forward/backward, right/left, up/down) and/or positioned at various angles. The displaceable flywheel 110 has a rotational axis, and, in one aspect, the body member 102 is formed such that the flywheel 110 is repositionable with respect to the body member 102. Repositioning the flywheel 110 within the body member 102, therefore, alters the rotational axis of the flywheel 110 with respect to the body member 102. The flywheel 110 can be arranged at different positions, up and down, so that the mobile toy 100 has variable ride heights. Furthermore, a central axis extends from the front portion 116 to the rear portion 118 of the body member 102, and the flywheel 110 is repositionable within the body member 102 at different angles. Repositioning of the flywheel 110 alters an angle between the central axis and the rotational axis of the flywheel 110. The flywheel 110 may also be arranged at various positions along the length of the mobile toy 100 (e.g., front and back) in addition to up and down or angled.

FIG. 2 illustrates a perspective-view of the flywheel 110 and sub-chassis 115, positioned within the bottom portion 106. The flywheel 110 includes an opening (or hub) to allow an axle, to be inserted through the opening. The axle may be comprised of any suitable material, non-limiting examples of which include plastic and metal. The axle extends through the opening of the flywheel 110 to both sides of the flywheel 110. In one aspect, the body member 102 further comprises a set of protrusions extending beyond the perimeter bounded by the front and rear portions of the body member 102. The protrusions are approximately aligned with the rotational axis of the displaceable flywheel 110. In this aspect, the axle is positioned in the set of protrusions, such that each protrusion operates as an axle cap. In another aspect, and as depicted in FIG. 2, each end of the axle is surrounded or covered by an axle cap 200. The axle cap 200 may be molded to each end of the axle or attached with the axle by any suitable mechanism, such as a snap-fit mechanism. As described above, notches in the bottom portion 106 allow for placement of the sub-chassis 115 and flywheel 110 into the bottom portion 106. Corresponding notches in the top portion provide clearance for the axle caps 200.

In a desired aspect, each axle cap 200 extends beyond the body member 102 of the mobile toy. The axle caps 200 allow the mobile toy to perform various stunts and tricks, such as spanning gaps between two strings or balancing on a side.

Other unique stunts which may be performed by the mobile toy are barrel rolls and top spins. Additionally, the mobile toy may ride on rails of a track using the axle caps 200. The axle caps 200 may be formed in various shapes, a non-limiting example of which includes hook-shaped axle caps. Depending on the size and shape of the axle caps 200, the mobile toy may be guided along a number of surfaces, non-limiting examples of which include a standard track, custom track, or wire. The axle caps 200 may remain stationary as the flywheel 110 rotates or rotate along with the flywheel 110. In an additional aspect, the axle caps 200 may be formed as gears to engage a geared track to climb or traverse a section of the track. Alternatively, the axle caps 200 may be magnetic so that the axle caps 200 attract a track also having magnetic elements. Additionally, the axle caps 200 may be formed to accept snap-on/detachably attachable extension elements, non-limiting examples of which include clip-on hooks, pipes, hands, loops, engines, gears, or other accessories to provide a variety of play experiences.

As shown in FIG. 3, the mobile toy 100 vehicle is powered by a ripcord 300 which is removably insertable inside the mobile toy 100 and is configured to induce rotation of the flywheel 110. The ripcord 300 induces rotation of the flywheel 110 by interlocking with at least a portion of the flywheel 110 or axle. In a desired aspect, the ripcord 300 is inserted into the mobile toy 100 at a location in the mobile toy 100 that does not interfere with the flywheel 110.

(1.2) Track Set with a Tiltable Surface

Figure 4:
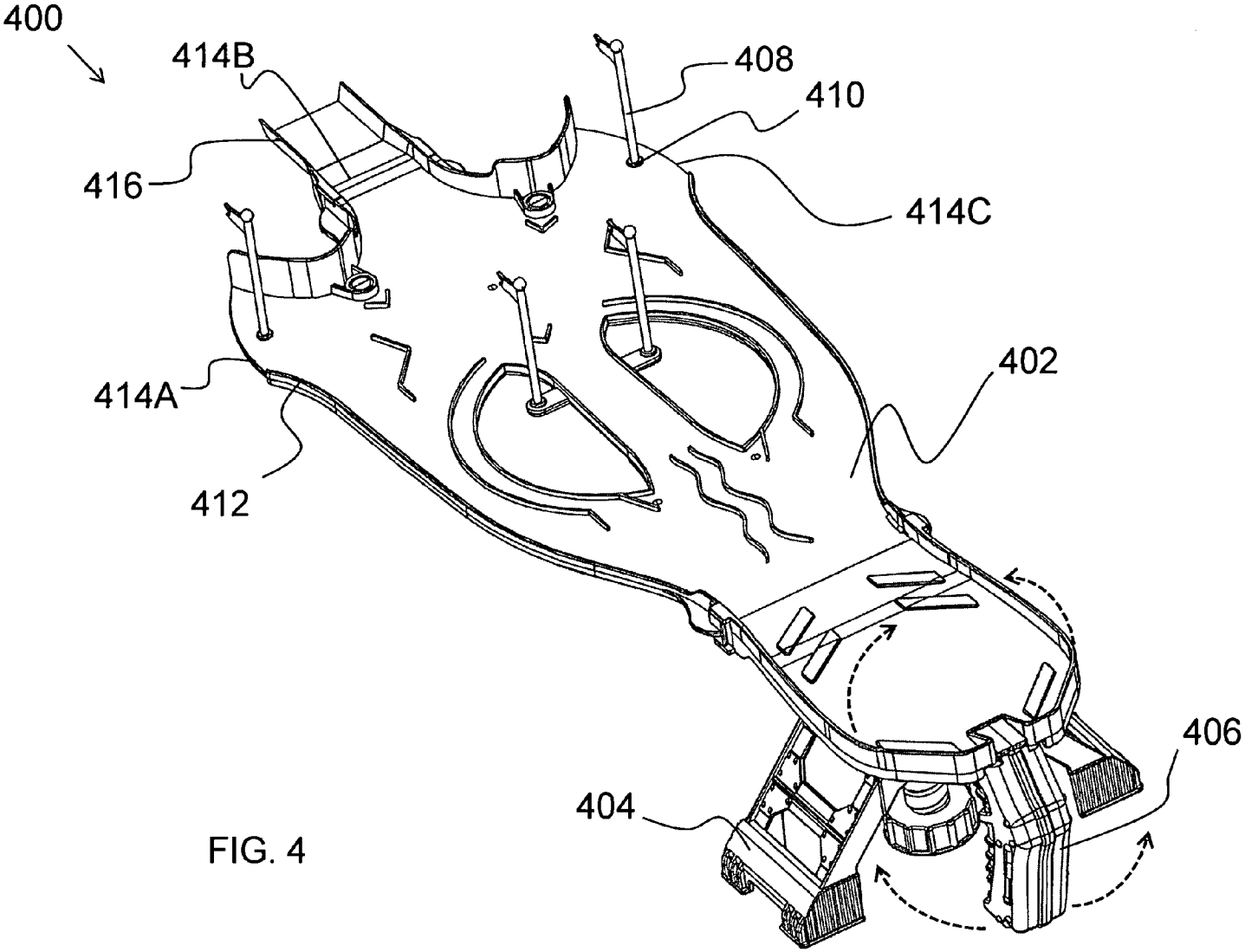
FIG. 4 is a perspective-view illustration of a track set according to the present invention.

As noted above and as shown in FIG. 4, the present invention is a track set 400 with a tiltable surface 402 for use with a toy vehicle. More specifically, the track set 400 includes a base 404 that can be rested upon a ground surface or table top, etc. The surface 402 upon which a toy vehicle can traverse is rotatably connected with the base 404. A handle 406 is attached with the surface 402 to allow a user to rotate the surface 402 with respect to the base 404 and thereby manipulate a toy vehicle traversing the surface 402.

The surface 402 is rotatably connected with the base 404 through any technique, mechanism or device for rotatably connecting such objects, non-limiting examples of which include a ball and socket joint, and a living hinge. Further, the base 404 can be directly or indirectly rotatably connected with the surface 402. An example of an indirect connection is described below with respect to the elevation adjuster.

To allow a toy vehicle to travel along the surface 402, the surface is formed in any suitable shape, a non-limiting example of which includes being a substantially planar surface. Alternatively, the surface 402 can be formed to include protrusions, depressions, and be curved or contoured. Further, the surface 402 is formed of any suitable material, a non-limiting example of which includes plastic.

Additionally, to provide for further interaction, the surface 402 can include obstacles 408 that are removably attachable with the surface 402. For example, the obstacles 408 are any suitable item that can be removably connected with the surface 402, a non-limiting example of which includes flags that are posted into holes 410 that are formed in the surface 402. Thus, a user can guide a toy vehicle into contact with the obstacles 408 to either alter the momentum of the toy vehicle or knock the obstacle 408 from the surface 402.

To maintain the toy vehicle upon the surface 402, side rails 412 can be optionally included. The side rails 412 are connected with or rise from the edge of the surface 402 to prevent the toy vehicle from falling from the surface 402.

Additionally, as the vehicle traverses the surface 402, the vehicle must ultimately exit the track set 402. As such, the surface 402 includes multiple exit points 414A, 414B, and 414C through which the toy vehicle can be guided off of the surface 402. The exit points are positions upon the surface 402 where there are no side rails 412. Further, a track 416 can be removably connected with surface 402 at one of the exit points (e.g., 414B). The track 416 is any suitably connectable track, a non-limiting example of which includes the standard u-shaped 1:64-scale die-cast car tracks.

Figure 5:
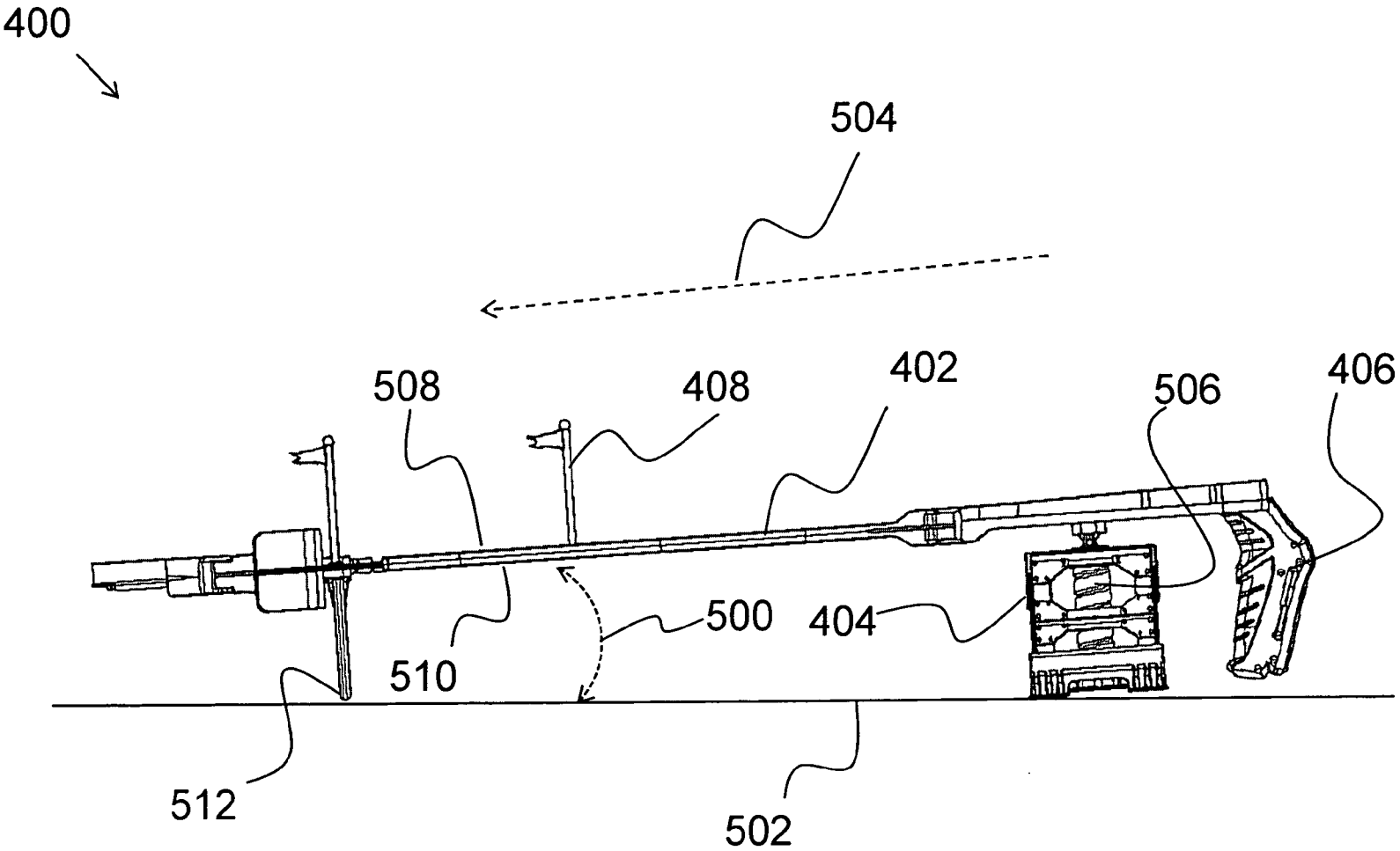
FIG. 5 is a left, side-view illustration of the track set.

As shown in the left, side-view illustration of FIG. 5, when the track set 400 is positioned upon a table top, etc., the surface 402 is at an angle 500 with respect to a ground plane 502. Thus, as can be appreciated by one skilled in the art, as the vehicle travels down 504 the surface 402, the angle 500 of the surface 402 will alter the speed of the vehicle. To control the angle 500 and ultimately the speed of the vehicle, an elevation adjuster 506 is attached with the surface 402. The elevation adjuster 506 is any suitable mechanism or device that allows a user to selectively raise and lower at least one end of the surface 402, thereby altering an angle 500 of the surface with respect to the ground plane 502. As a non-limiting example, the elevation adjuster 506 is a screw that passes through threads in the base 400. In this aspect, the base 400 is connected with the surface 402 via the elevation adjuster 506, which is pivotally connected with the surface 402.

Additionally, the surface 402 includes a first side 508 and a second side 510. A pivot point 512 is connected with at least one of the first and second sides 508 and 510. Thus, rotating the surface 402 using the handle 406 causes the surface 402 to pivot (i.e., rotate or tilt) about the pivot point 512 and thereby tilt the surface 402.

Thus, in operation, the toy vehicle is a flywheel powered vehicle, with the flywheel being rotated using a removably insertable ripcord. The toy vehicle, oriented on its side, rotates on the flywheel's axis (or axle cap, depicted as element 200 in FIG. 2) using the flywheel's inertia. Thus, the toy vehicle actually travels down the surface 402 on its axle caps while rotating on its side. There are removably attachable obstacles 408 on the surface 402 that the toy vehicle can be translationally guided to impact. The toy vehicle can also be guided out one of multiple exit points, one of which is a racing track where the toy vehicle is forced onto its wheels for forward translation. The toy vehicle is guided by manipulating the handle 406 that is attached to the surface 402 itself. The handle 406 is used to pivot the surface 402 and therefore guide the toy vehicle. The height of the surface 402 is adjustable (via the elevation adjuster 506) which results in different angles 500.

Figure 6:
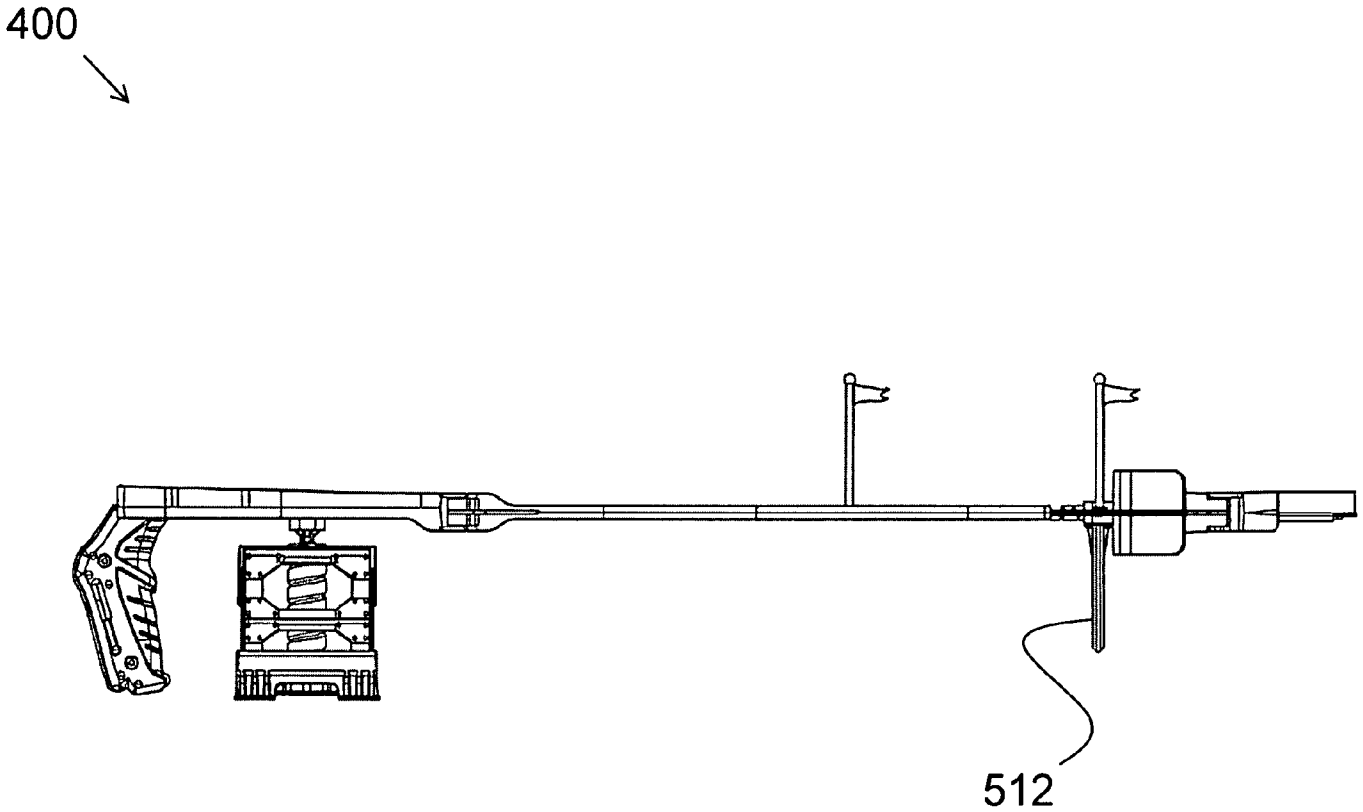
FIG. 6 is a right, side-view illustration of the track set.
Figure 7:
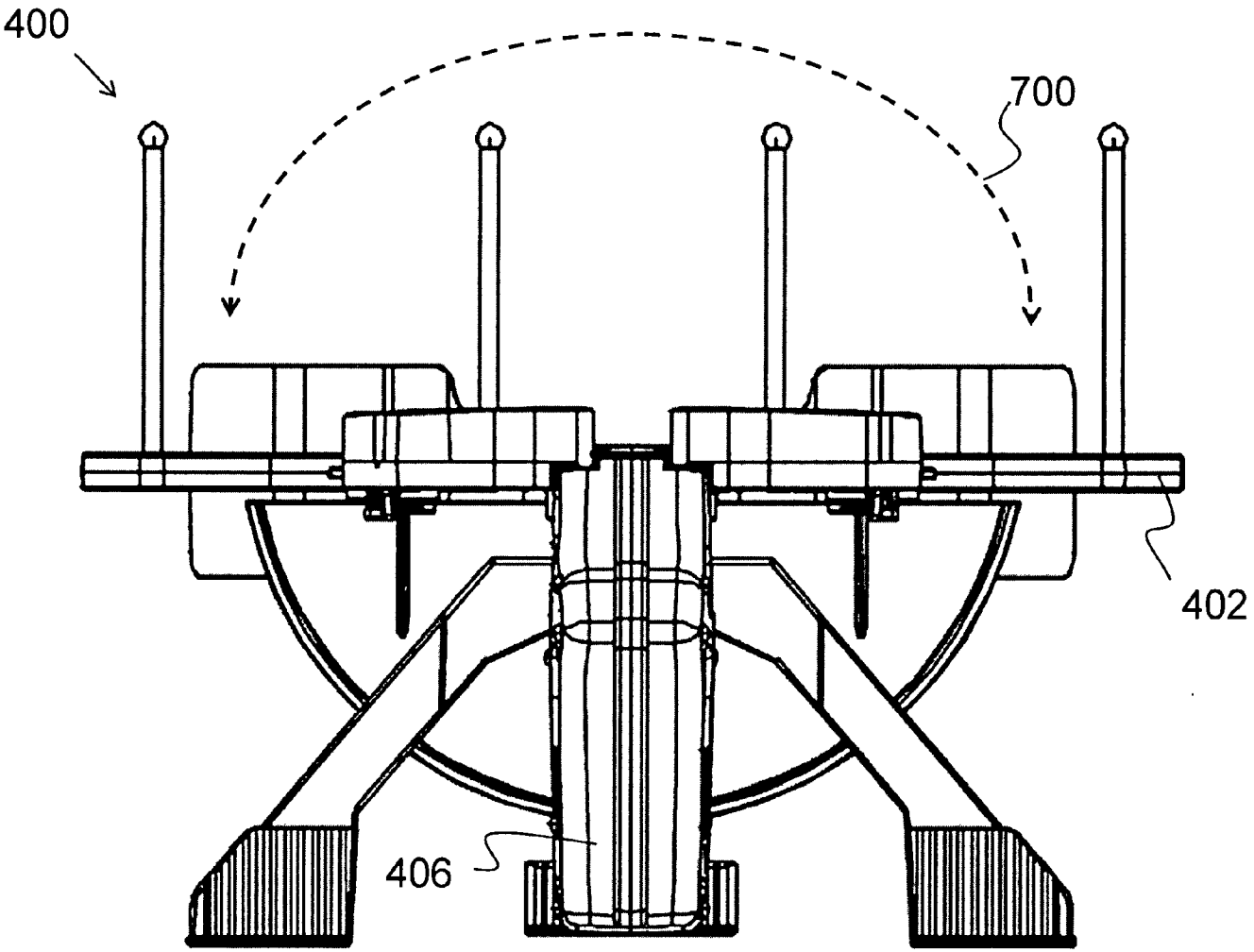
FIG. 7 is a rear-view illustration of the track set.

For further understanding, FIG. 6 provides a right, side-view illustration of the track set 400. Additionally, FIG. 7 provides a rear-view illustration of the track set 400. As clearly shown in FIG. 7, the handle 406 is attached with the surface 402 to allow a user to rotate 700 or otherwise manipulate (e.g., raise and/or lower) the surface.

Figure 8:
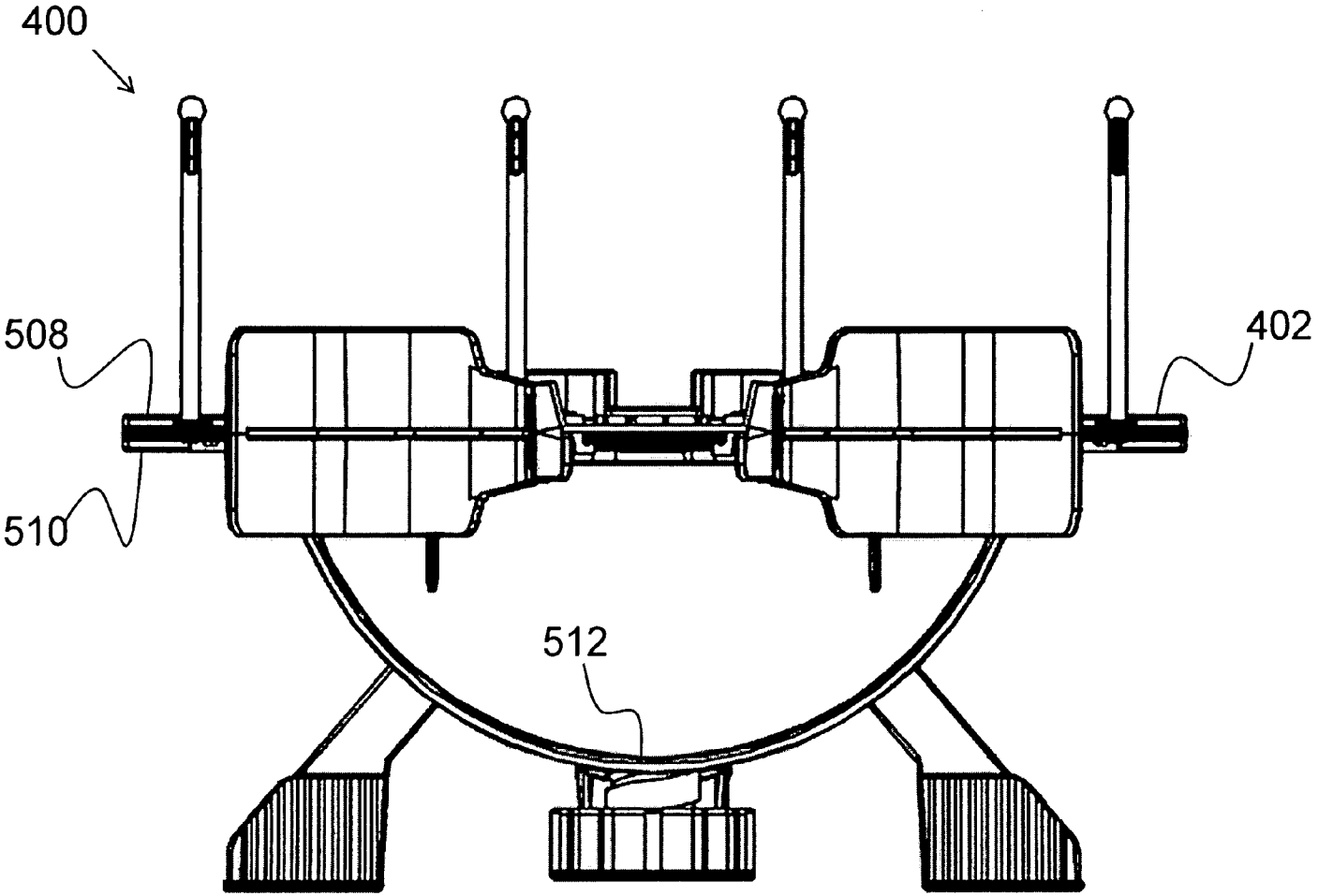
FIG. 8 is a front-view illustration of the track set.

FIG. 8 depicts a front-view illustration of the track set 400. As can be understood by one skilled in the art, the pivot point 512 is formed on any suitable item that allows a user to selectively manipulate the surface 402. As a non-limiting example, the pivot point 512 is formed as a semi-circular attachment that is detachably attachable with at least one of the first side 508 and second side 510. Thus, by resting the semi-circular attachment against a ground plane or surface (e.g., tabletop), a user can use the handle to rotate the surface 402, with the surface 402 pivoting as the semi-circular attachment rotates across the ground plane.

As can be appreciated by one skilled in the art, FIGS. 6, 7, and 8 depict orthogonal views of the track set 400. As such, the pivot point 512 in these images is not depicted as touching the ground plane. However in operation, the surface 402 would be angled downward by resting the pivot point 512 on the ground plane 502 (as depicted in FIG. 5).

Figure 9:
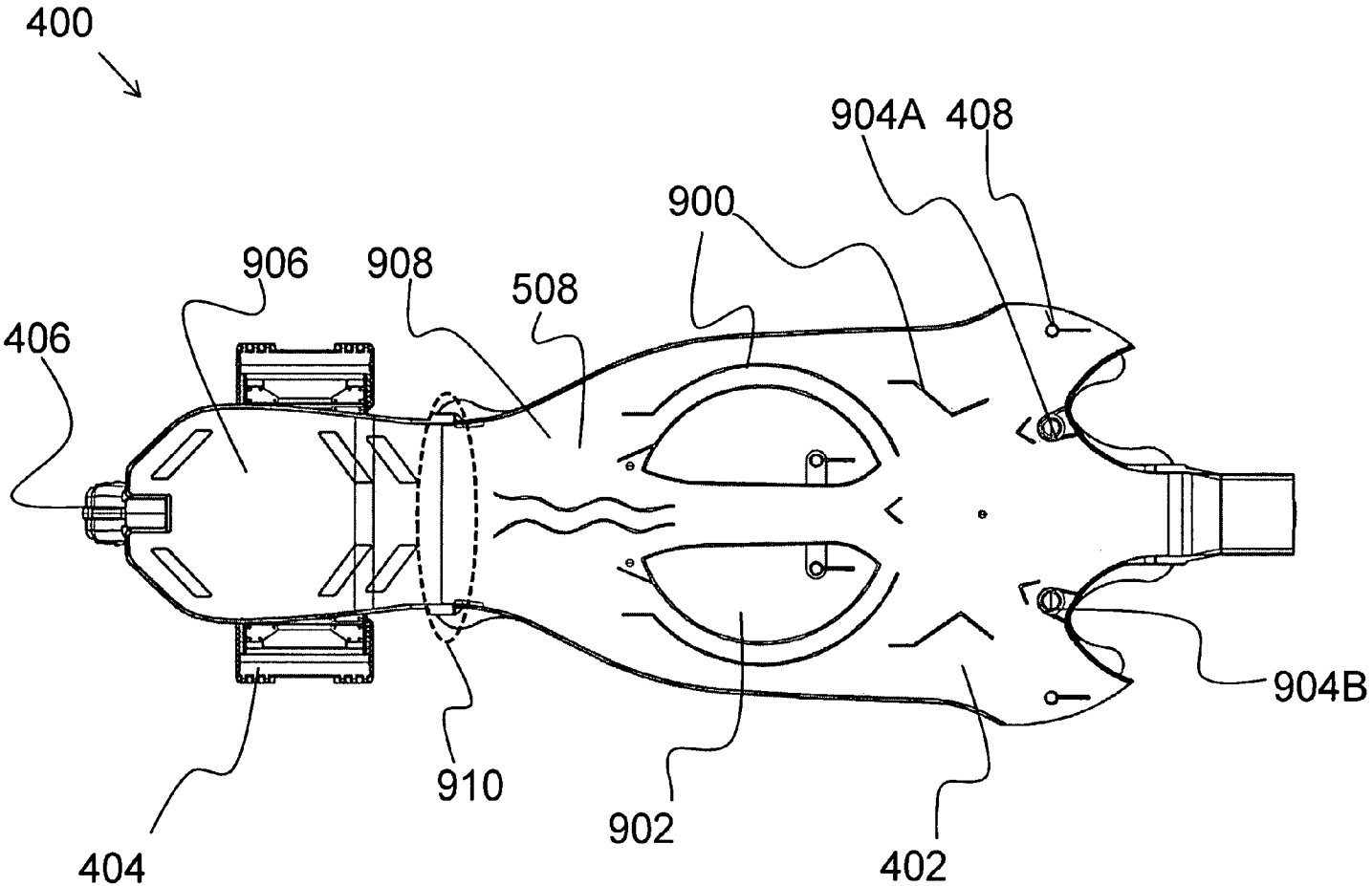
FIG. 9 is a top-view illustration of the track set.
Figure 10:
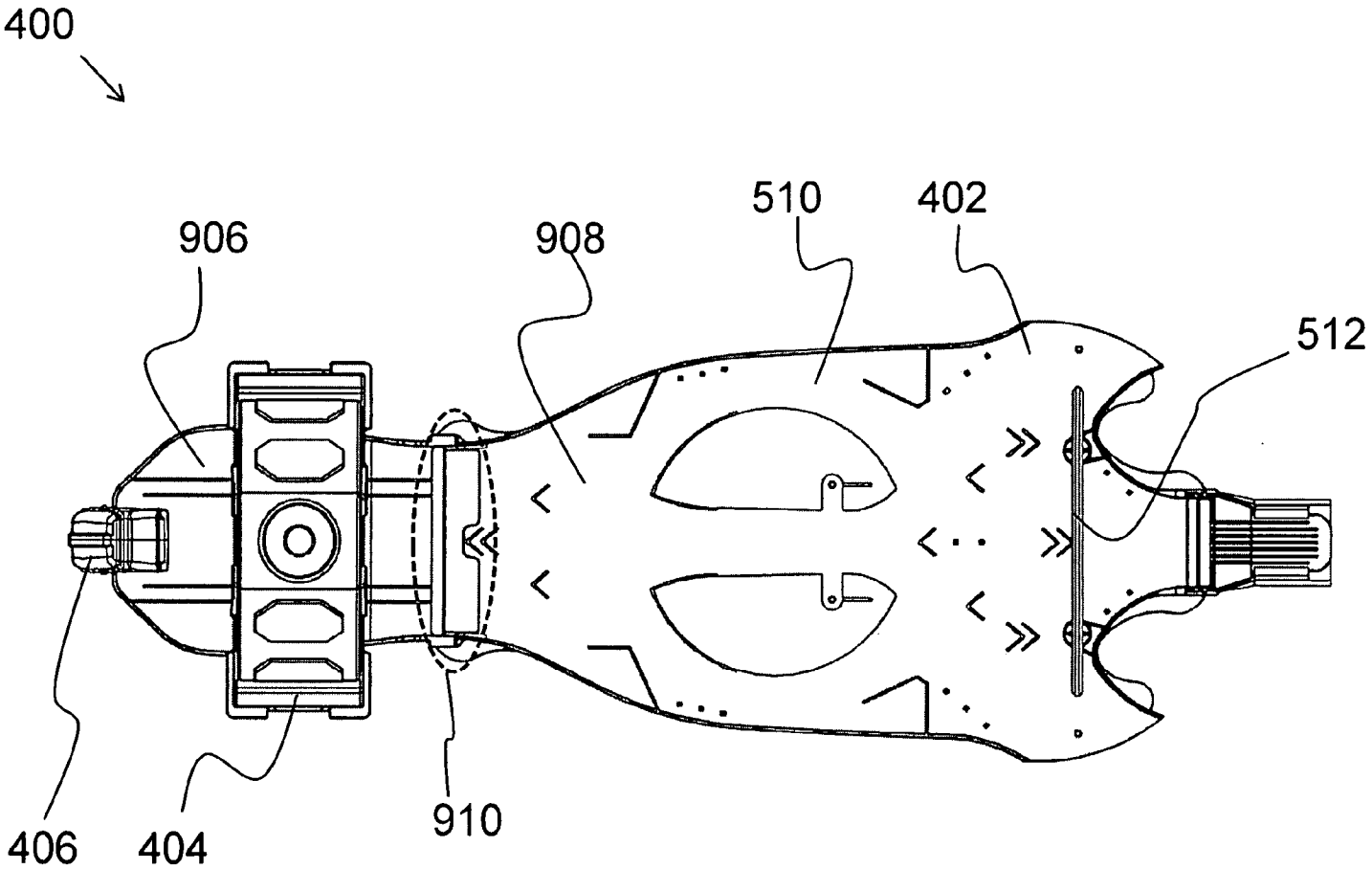
FIG. 10 is a bottom-view illustration of the track set.

Additionally, FIGS. 9 and 10 depict a top-view and bottom-view, respectively, of the track set 400. As shown in FIG. 9, the first side 508 of the track set 400 includes a distinct play pattern or track pattern with various guard rails 900 and a hole 902 formed through the surface 402. By altering the pattern on the surface 402, including the position of the guard rails 900 and obstacles 408, each side of the surface 402 can have a distinct play pattern. Thus, to use the alternative side (i.e., the second side) of the surface, the pivot point needs to be repositionable. Thus, the surface 402 includes pivot connectors 904A and 904B (singular or plural). The pivot connectors 904A and 904B are any suitable mechanism or device that allows a user to selectively detach and attach a pivot point to the desired side. In this case and as a non-limiting example, the pivot connectors 904A and 904B are formed as holes that receive a corresponding peg on the pivot point.

Further, to allow a user to selectively decide which side of the surface (i.e., the first side or the second side) to use, the base 404 and handle 406 need to be similarly reconfigured. In one aspect, the track set 400 can be designed such that the base 404 and handle 406 simply detach and reattach with an opposite side of the surface 402.

Alternatively, the surface 402 can be formed to have a first surface part 906 that is detachably attachable with a second surface part 908. The first surface part 906 can be detachably attached with the second surface part 908 using any suitable attachment mechanism or technique. As a non-limiting example, a tongue and groove assembly 910 is used to detachably attach the two parts 906 and 908. Thus, in this aspect, the base 404 and handle 406 are fixedly attached with the first surface part 906. When a user decides to use the second side of the surface 402, the user can detach the pivot point from the second side, and reattach the pivot point on the first side 508 using the pivot connectors 904A and 904B. Additionally, the user can detach the first surface part 906 from the second surface part 908 and simply flip and reattach the two parts 906 and 908.

For further understanding, FIG. 10 depicts a bottom-view illustration of the track set 400 in the configuration depicted in FIGS. 4 through 9. However, as shown, the second side 510 includes a play pattern that is distinct from the first side. Thus, as can be appreciated by one skilled in the art and as described above, the pivot point 512 can be removed from the second side 510 and repositioned on the first side. Additionally, the first surface part 906 can be removed from the second surface part 908. Thereafter, the first surface part 906 can be flipped with respect to the second surface part 908 and reattached (via the tongue and groove assembly 910). Thus, the base 404, handle 406 and pivot point 512 would all be on the same side as the first side (which is to be pointed down), while freeing the second side 510 (which is now to be pointed up) for use with a toy vehicle.

In summary, the present invention is a track set with a tiltable surface 402 for use with a toy vehicle. The track set includes a handle 406 that allows a user to tilt the surface 402 while resting the track set 400 on a base 404 and tilting the surface at a pivot point 512. Further, the surface 402 includes a first side 508 and a second side 510. The track set 400 is formed to allow a user to switch the position of the pivot point 512 and base 404 and thereby selectively use either the first side 508 or second side 510.

What is claimed is:

1. A track set with a tiltable surface for use with a toy vehicle, comprising:

a base;

a surface upon which a toy vehicle can traverse, the surface having a first side and a second side and being rotatably connected with the base, and wherein the surface includes pivot connectors formed on both the first and second sides for selective attachment and detachment with a pivot point; and a handle attached with the surface to allow a user to rotate the surface with respect to the base and thereby manipulate a toy vehicle traversing the surface; and a pivot point that is substantially planar and semi-circular, the pivot point structure being formed to allow for selective attachment and detachment with the pivot connectors on at least one of the first and second sides, such that rotating the surface using the handle causes the surface to tilt laterally about the pivot point structure.

2. The track set as set forth in claim 1, wherein the surface is a substantially planar surface, and wherein the pivot connectors are formed as holes in the surface of both the first and second sides.

3. The track set as set forth in claim 2, wherein the pivot point structure includes pegs that are formed to selectively attach and detach with the holes that are formed on the first and second sides of the surface, thereby allowing a user to selectively attach the pivot point structure with the first or second side.

4. The track set as set forth in claim 3, further comprising obstacles that are removably attachable with the surface, whereby a user can guide a toy vehicle into contact with the obstacles.

5. The track set as set forth in claim 4, wherein the surface includes side rails to maintain a toy vehicle thereon; and wherein the surface further comprises:

a first surface part and a second surface part;

a tongue and group assembly separating the first surface part from the second surface part, such that the first surface part is detachably attachable with the second surface part through the tongue and groove assembly;

wherein the base and handle are fixedly attached with the first surface part and the pivot connectors are formed on the second surface part, whereby when a user decides to use the second side of the surface as opposed to the first side, the user can detach the pivot point from the second side, and reattach the pivot point on the first side using the pivot connectors, the user can also detach the first surface part from the second surface part and then turn over the second surface part and then reattach the second surface part to the first surface part.

6. The track set as set forth in claim 5, wherein the surface includes multiple exit points through which the toy vehicle can be guided off of the surface.

7. The track set as set forth in claim 6, further comprising includes an elevation adjuster attached with surface to elevate at least one end of the surface and alter an angle of the surface with respect to a ground plane.

8. The track set as set forth in claim 1, further comprising obstacles that are removably attachable with the surface, whereby a user can guide a toy vehicle into contact with the obstacles.

9. The track set as set forth in claim 1, wherein the surface further comprises:

a first surface part and a second surface part;

a tongue and group assembly separating the first surface part from the second surface part, such that the first surface part is detachably attachable with the second surface part through the tongue and groove assembly;

wherein the base and handle are fixedly attached with the first surface part and the pivot connectors are formed on the second surface pan, whereby when a user decides to use the second side of the surface as opposed to the first side, the user can detach the pivot point from the second side, and reattach the pivot point on the first side using the pivot connectors the user can also detach the first surface part from the second surface part and then turn over the second surface part and then reattach the second surface pan to the first surface part.

10. The track set as set forth in claim 1, wherein the surface includes multiple exit points through which the toy vehicle can be guided off of the surface.

11. The track set as set forth in claim 1, further comprising an elevation adjuster attached with surface to elevate at least one end of the surface and alter an angle of the surface with respect to a ground plane.

12. A method for forming a track set with a tiltable surface for use with a toy vehicle, comprising acts of:

forming a base;

forming a surface upon which a toy vehicle can traverse, the surface having a first side and a second side, the surface also including pivot connectors formed on both the first and second sides for selective attachment and detachment with a pivot point structure;

rotatably connecting the surface being with the base; and attaching a handle with the surface to allow a user to rotate the surface with respect to the base and thereby manipulate a toy vehicle traversing the surface; and further comprising an act of forming a pivot point structure that is substantially planar and semi-circular, the pivot point structure being formed to allow for selective attachment and detachment with the pivot connectors on at least one of the first and second sides, such that rotating the surface using the handle causes the surface to tilt laterally about the pivot point structure.

13. The method as set forth in claim 12, wherein in forming the surface, the surface is formed to be a substantially planar surface, and wherein the pivot connectors are formed as holes in the surface of both the first and second sides.

14. The method as set forth in claim 13, wherein the pivot point structure includes pegs that are formed to selectively attach and detach with the holes that are formed on the first and second sides of the surface.

15. The method as set forth in claim 12, further comprising an act of forming obstacles that are removably attachable with the surface, whereby a user can guide a toy vehicle into contact with the obstacles.

16. The method as set forth in claim 12, wherein the surface is formed to include side rails to maintain a toy vehicle thereon.

17. The method as set forth in claim 12, wherein the surface is formed to include multiple exit points through which the toy vehicle can be guided off of the surface.

18. The method as set forth in claim 12, further comprising an act of forming an elevation adjuster for attaching with surface to elevate at least one end of the surface and alter an angle of the surface with respect to a ground plane.

* * * * *